US005144906A

United States Patent [19]

Kraemer

[11] Patent Number: 5,144,906

[45] Date of Patent: Sep. 8, 1992

[54] SEA MARKER

[75] Inventor: Daniel Kraemer, Kirchheimbolanden, Fed. Rep. of Germany

[73] Assignee: Piepenbrock Pyrotechnik GmbH, Goellheim, Fed. Rep. of Germany

[21] Appl. No.: 683,833

[22] Filed: Apr. 11, 1991

[30] Foreign Application Priority Data

Apr. 27, 1990 [DE] Fed. Rep. of Germany ..... 4013516

[51] Int. Cl.[5] ..... B63B 45/02; F42B 4/26

[52] U.S. Cl. ..... 116/209; 116/26; 116/DIG. 40; 116/DIG. 43; 102/341

[58] Field of Search ..... 116/26, DIG. 40, DIG. 43, 116/209, 202, 107, 211, 214; 102/341; 441/11, 13, 14

[56] References Cited

U.S. PATENT DOCUMENTS

| | | | |
|---|---|---|---|
| 2,119,697 | 6/1938 | Anderson | 102/341 |
| 2,263,585 | 11/1941 | Moore et al. | 116/26 |
| 2,789,501 | 4/1957 | Sawicki | 116/DIG. 40 X |
| 3,619,306 | 11/1967 | Berthmann | 149/18 |
| 3,680,483 | 8/1972 | Staudacher et al. | 102/37.8 |
| 3,759,216 | 9/1973 | Sanders et al. | 102/341 |
| 3,762,327 | 10/1973 | Murray et al. | 102/341 |
| 3,804,021 | 4/1974 | McGirr | 102/70 R |
| 4,128,443 | 12/1978 | Pawlak et al. | 149/71 |
| 4,155,307 | 5/1979 | Kluchert et al. | 102/341 |
| 4,393,779 | 7/1983 | Brede et al. | 102/202.5 |

FOREIGN PATENT DOCUMENTS

| | | | |
|---|---|---|---|
| 0693479 | 2/1961 | Canada | 116/209 |
| 0345845 | 6/1972 | Sweden . | |
| 1084944 | 9/1967 | United Kingdom . | |

OTHER PUBLICATIONS

Handbook of Pyrotechnics by Karl O. Brauer 1974, pp. 14–18 and 164–166.

The Encyclopedia Americana, International Ed. vol. 13, 1978, pp. 619–620.

Chemistry and Technology of Explosives by Tadeusz Urbanski 1984, pp. 506–514.

*Primary Examiner*—William A. Cuchlinski, Jr.
*Assistant Examiner*—John L. Beres
*Attorney, Agent, or Firm*—Foley & Lardner

[57] ABSTRACT

A sea marker for emergency flights of ship-based planes onto a ship is disclosed which comprises a float, a tube containing a pyrotechnical charge and also a percussion igniter. The tube consists of a material which does not burn away, and is provided with a light charge consisting of about 30 to 60% by weight of sodium nitrate, about 3 to 18% by weight of polyolefin resin and about 30 to 60% by weight of magnesium.

16 Claims, 1 Drawing Sheet

SEA MARKER

BACKGROUND OF THE INVENTION

The present invention relates to a sea marker for emergency flights of ship-based planes on to ships.

In cases of poor conditions of visibility, sea markers are thrown into the sea from ships in order to simplify the approach and landing of aircraft and especially of ship-borne helicopters. Such sea markers comprise a tube with a float and a pyrotechnical charge provided in the tube which emits a light signal with combustion for several minutes.

Conventional sea markers suffer from the disadvantage that the material of the tube must be so chosen that, as a result of the high temperatures resulting from the combustion of the light charge, they also burn. This necessitates the construction of the float below the tube and has a negative influence on the dependability of the combustion process. The ignition of the pyrotechnical charge thereby takes place by means of a percussion igniter arranged on the head.

SUMMARY OF THE INVENTION

It is an object of the present invention to provide a sea marker which has an increased light efficiency, makes possible a simplified construction in which the tube does not burn simultaneously and, in addition, is dependable in handling and is storage stable.

In accordance with these and other objects of the invention, a sea marker for emergency flights of ship-based planes onto a ship is provided which comprises a float, a tube containing a pyrotechnical charge, and a percussion igniter, wherein the tube consists of a material which does not burn and is provided with a light charge consisting essentially of about 30 to 60% by weight of sodium nitrate, about 3 to 18% by weight of polyolefin resin and about 30 to 60% by weight of magnesium.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
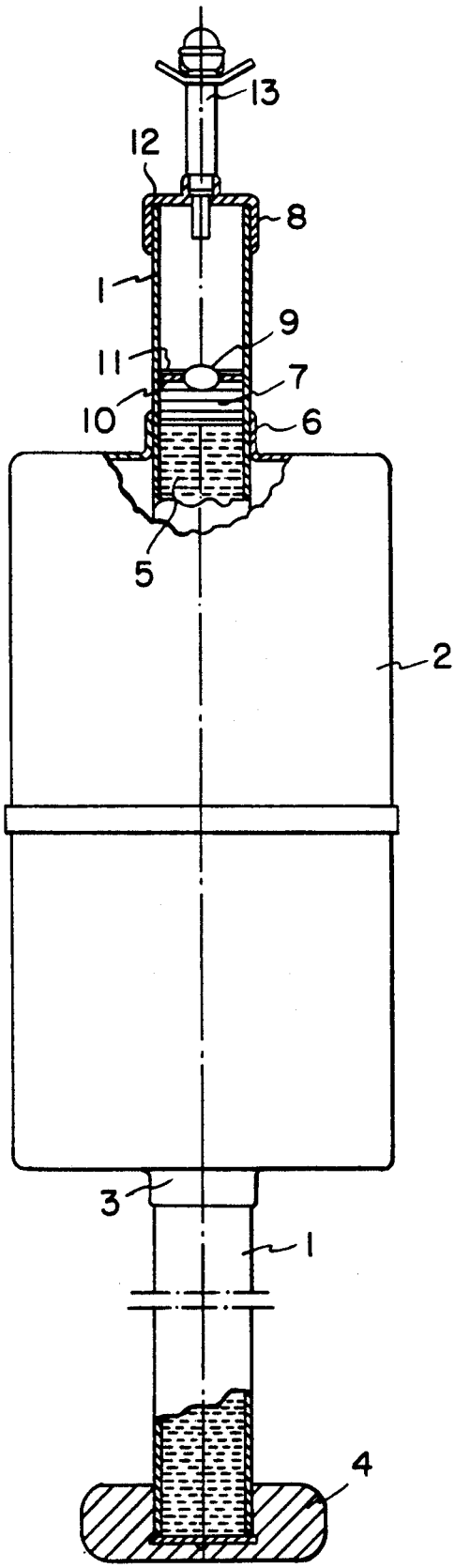
FIG. 1 shows a sea marker according to the invention.

According to the present invention, a sea marker for emergency flights of ship-based planes from ships comprises a float, as well as a tube containing a pyrotechnical charge and also a percussion igniter. The tube consists of a material which does not burn, for example, steel, and is provided with a light charge consisting essentially of about 30 to 60% by weight of sodium nitrate, about 3 to 18% by weight of polyolefin resin and about 30 to 60% by weight of magnesium.

Surprisingly, such a light charge burns away from a tube which does not burn simultaneously, for example, one made of steel sheet, without a loss of illuminating power, but rather with increased light efficiency even though the combustion front proceeds continuously towards the bottom, i.e., away from the opening on the head side.

In order to ensure a uniform and chronologically constant ignition, according to the present invention, the light charge is superimposed by an intermediate charge comprising about 40 to 80% by weight of barium nitrate, about 1 to 10% by weight of sulphur, about 1 to 10% by weight of charcoal and about 1 to 5% by weight of powdery gunpowder. Preferably it also comprises about 1 to 10% by weight of two-component gunpowder, about 0 to 1% by weight of methyl cellulose and about 0 to 1% by weight of silicic acid. A primer is arranged on the intermediate charge and comprises about 50 to 70% by weight of barium chromate, about 10 to 20% by weight of potassium perchlorate and about 20 to 30% by weight of zirconium/nickel, which is ignited by the percussion igniter. The primer can also contain up to about 1% by weight of highly-dispersed fumed silica.

A conventional percussion igniter is applied to the tube shortly before use. It contains a delay so that after activation the marker can be thrown manually into the sea. In the case of ignition and over-ignition to the intermediate charge and the light charge, a considerable gas pressure is produced which can result in the sea marker burning under high pressure and the cover and igniter being thrown upwardly.

In order not to endanger an approaching aircraft, it is preferable to close the tube with a cap made of synthetic material, in the middle of which is fastened, for example, by screwing, the percussion igniter. The cap is provided with holes through which the gas overpressure can escape. In order to ensure water- and water vapour-tightness of the cap and igniter they are preferably covered with lead/tin foil.

Under the influence of the hot combustion flame, the cap burns, the percussion igniter is slightly ejected and the upper tube opening is freed for the emergence of the marking guide.

In an especially preferred embodiment, the primer is cast and, after hardening, applied to a holed disc which itself is held on the inner wall of the tube by means of a retaining ring. For this purpose, the primer is previously mixed with a binding agent, which is preferably polychlorobutadiene. In the case of ignition, the primer on the holed disc develops precisely the pressure necessary to open the bores in the synthetic material cover without allowing water to penetrate into the sea marker. This enables the device to function under water.

In addition, the intermediate charge and the light charge are preferably compacted with about 1 to 8% by weight of binding agent. A preferred binder comprises, in particular, a solvent-free polyurethane adhesive which, on the one hand, simplifies the production as pressed material and, on the other hand, equalises the burning.

In order to improve storage stability, it is preferred to coat the inner wall of the tube with a friction-increasing or adhesive material. For this purpose vinyl acetate copolymer has proved to be especially suitable. Above the igniter, there must be a free space for the ignition. The friction-increasing agent firmly holds the whole charge in the tube to such an extent that the simple retaining ring, which is arranged on the holed disc carrying the igniter, suffices safely to fix the charge in the case of impact to the tube, for example, due to dropping. Surprisingly, it has been found that the addition of about 1 to 5% by weight of plasticiser to the vinyl acetate in the form of a phthalic acid ester (Palatinol ®) provides several advantages. In addition to the plasticising property and an associated improvement in the handling and of the prevention of flaking from the wall of the tube, a mass is obtained which possesses very good insulating and evaporation properties and which also greatly increases the burning times. Burning times increased by up to fourfold have been observed. The result of this is that a substantially hotter and more rapidly burning light charge can be used with the same burning-away time. A more uniform combustion and an increased light efficiency result. Burning and glowing parts are not ejected and the development of smoke is reduced to a minimum.

It is preferred to mix the intermediate charge with about 1 to 10% by weight of two-component gunpowder (potassium nitrate with charcoal) in order to improve the reproducability, ignition and speed of combustion.

According to the present invention, the sea marker can be especially simple in construction. It consists essentially of a tube which contains the pyrotechnical charge and which is surrounded by a float in the form of a mantel. The mantel preferably has at least one lower and one upper bore which are arranged in such a manner that the float is flooded with seawater as it loses weight due to the burning away of the pyrotechnical charge and subsequently sinks.

The present invention will now be explained in more detail with reference to the accompanying drawings.

As seen in FIG. 1, the sea marker comprises tube 1, the upper part of which is surrounded by a hollow mantel or float 2. Float 2 is pushed on to tube 1 and welded with it, for example, via sleeves 3 and 6. Both parts can be made of steel sheet.

On the lower part of the tube is trimming weight 4 which keeps the marker in a vertical position. In tube 1 is light charge 5 which is ignited by intermediate charge 7 arranged above light charge 5. The intermediate charge functions as a time delay for the opening of the head of the marker which is closed with cap 8 made of synthetic material. Intermediate charge 7 is itself ignited by primer 9 which, previously produced as a cast body in holed disc 10, is laid upon intermediate charge 7. Holed disc 10 is secured by elastic retaining ring 11. In addition, the inner wall of the tube is coated, preferably with vinyl acetate, to provide an increased safety against impact and blows in a very simple manner. For this purpose, as already mentioned, intermediate charge 7 and light charge 5 are adapted to or pressed into tube 1 as a cylindrically-shaped formed body.

Synthetic material cap 8 has holes 12 which can be covered by lead/tin foil in order to protect the contents of the tube against water spray before combustion.

In the synthetic material cap is provided conventional percussion igniter 13 which, after tearing off the safety means, ignites primer 9 with a delay of about 3.5 seconds.

The hot gases first escape through holes 12 in order to avoid the formation of an overpressure and subsequently burn the synthetic material cap and press against the percussion igniter relatively gently.

Figure 2:
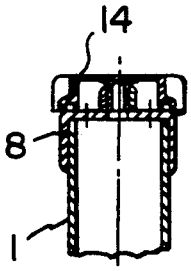
FIG. 2 is a detailed view of the protective cap of the sea marker.

Percussion igniter 13 is screwed into synthetic material cap 8 only shortly before use of the sea marker. In the case of storage and transport prior to use, the synthetic material cap is closed with protective cap 14, as is shown in FIG. 2.

Primer 9 is produced by mixing the components with a hardening binding agent and preferably with the use of Aerosil ® (trade mark of Degussa). The mixture is cast in a highly-viscous state on to the hole of the holed disc in order to harden there, after which assembly takes place.

An especially preferred composition is described in the following:

Primer:

| | |
|---|---|
| barium chromate | 50–70% by weight |
| potassium perchlorate | 10–20% by weight |
| zirconium/nickel | 20–30% by weight |

This is mixed with polychlorobutadiene (polychloroprene) as binding agent in an amount of 10 to 30% by weight.

Intermediate charge:

| | |
|---|---|
| barium nitrate | 75% by weight |
| sulphur | 10% by weight |
| charcoal | 10% by weight |
| powdery gunpowder | 3% by weight |
| two-component gunpowder | — |
| methyl cellulose | 0.5% by weight |
| silicic acid | 1% by weight |
| binding agent | 10% by weight |

As binding agent, there is used a polychlorobutadiene adhesive (Macroplast ®, trademark of Henkel).

Light Charge:

| | |
|---|---|
| sodium nitrate | 30% by weight |
| polyolefin resin | 20% by weight |
| magnesium | 40% by weight |
| binding agent | 10% by weight. |

Microthene ® is used as polyolefin resin.

What is claimed is:

1. A sea marker for emergency flights of ship-based planes onto a ship, comprising:

a float, a tube supported by said float and containing a pyrotechnical charge, an intermediate charge superimposed on said pyrotechnical charge, a primer arranged on said intermediate charge, said primer being cast on to a holed disc which is held against an inner wall of the tube with a retaining ring, and a percussion igniter, wherein the tube comprises a material which does not burn and said charge consists essentially of about 30 to 60% by weight of sodium nitrate, about 3 to 18% by weight of polyolefin resin and about 30 to 60% by weight of magnesium.

2. A sea marker according to claim 1, wherein the intermediate charge consists essentially of about 40 to 80% by weight of barium nitrate.

3. A sea marker according to claim 1, wherein the tube is closed with a cap of synthetic material adapted to receive the percussion igniter, the cap being provided with holes and being covered with a lead/tin foil.

4. A sea marker according to claim 2, wherein the primer consists essentially of about 50 to 70% by weight of barium chromate, about 10 to 20% by weight of potassium perchlorate and about 20 to 30% by weight of zirconium/nickel alloy.

5. A sea marker according to claim 2, wherein the intermediate charge and the pyrotechnical charge are each compacted with about 1 to 8% by weight of a binding agent and an inner wall of the tube is provided with an adhesive coating.

6. A sea marker according to claim 5, wherein the binding agent is polychlorobutadiene.

7. A sea marker according to claim 5, wherein the adhesive coating consists of vinyl acetate copolymer.

8. A sea marker according to claim 7, wherein the adhesive coating of vinyl acetate copolymer contains about 1 to 5% by weight of a phthalic acid ester.

9. A sea marker according to claim 1, wherein the primer consists essentially of about 50 to 70% by weight of barium chromate, about 10 to 20% by weight of potassium perchlorate and about 20 to 30% by weight of zirconium/nickel alloy.

10. A sea marker according to claim 9, wherein the intermediate charge consists essentially of about 40 to 80% by weight of barium nitrate, about 1 to 10% by weight of sulphur, about 1 to 10% by weight of charcoal and about 1 to 5% by weight of powdery gunpowder consisting essentially of potassium nitrate, sulfur and charcoal.

11. A sea marker according to claim 10, wherein the primer additionally consists essentially of up to about 1% by weight of highly-dispersed fumed silica.

12. A sea marker according to claim 10, wherein the intermediate charge additionally consists essentially of about 1 to 10% by weight of two-component gunpowder, up to about 1% by weight of methyl cellulose and up to about 1% by weight of silicic acid.

13. A sea marker according to claim 1, wherein the float surrounds the tube as a mantel.

14. A sea marker according to claim 13, wherein the mantel-shaped float has an upper and a lower fine bore, said bores being dimensioned such that the float is flooded as the charge burns and the sea marker sinks after the charge has burned away.

15. A sea marker according to claim 1, wherein an inner wall of the tube is provided with an adhesive coating consisting of vinyl acetate containing about 1 to 5% by weight of a phthalic acid ester.

16. A sea marker for emergency flights of ship-based planes onto a ship, comprising:

a float, a tube supported by said float and containing a pyrotechnical charge, an intermediate charge superimposed on said pyrotechnical charge, a primer arranged on said intermediate charge, and a percussion igniter, wherein the tube comprises a material which does not burn and said charge consists essentially of about 30 to 60% by weight of sodium nitrate, about 3 to 18% by weight of polyolefin resin and about 30 to 60% by weight of magnesium wherein the intermediate charge and the pyrotechnical charge are each compacted with about 1 to 8% by weight of a binding agent and an inner wall of the tube is provided with an adhesive coating of vinyl acetate containing about 1 to 5% by weight of a phthalic acid ester.

* * * * *